United States Patent [19]

Keck et al.

[11] Patent Number: 4,707,933

[45] Date of Patent: Nov. 24, 1987

[54] WALL MOUNTED DRYER

[75] Inventors: Henry C. Keck, Pasadena; Roy K. Fujitaki, Altadena, both of Calif.

[73] Assignee: Bobrick Washroom Equipment, Inc., North Hollywood, Calif.

[21] Appl. No.: 858,360

[22] Filed: Apr. 30, 1986

[51] Int. Cl.[4] ..... F26B 9/00

[52] U.S. Cl. ..... 34/97; 34/241; 219/366

[58] Field of Search ..... 34/97, 202, 241; 219/366, 367

[56] References Cited

U.S. PATENT DOCUMENTS

| | | | |
|---|---|---|---|
| 1,070,716 | 8/1913 | Myers | 34/97 |
| 3,076,887 | 2/1963 | Bulow | 219/366 |
| 3,378,009 | 4/1968 | Peplin | 34/202 |
| 3,775,590 | 11/1973 | Gartner | 219/366 |
| 4,037,079 | 7/1977 | Armbruster | 219/366 |

*Primary Examiner*—Albert J. Makay
*Assistant Examiner*—David W. Westphal
*Attorney, Agent, or Firm*—Lyon & Lyon

[57] ABSTRACT

A wall-mounted dryer of the type for drying a person's hands, face and hair with blowing heated air. The inlet for air into the dryer is formed by a narrow opening around the periphery, except on top, along the surface of the wall for inhibiting the entry of foreign objects, such as by vandals. The narrow opening has inclined louvres for further reducing the size of the openings into the dryer.

6 Claims, 4 Drawing Figures

WALL MOUNTED DRYER

This invention relates to a wall mounted dryer of the type that is mounted on a wall and dispenses hot air for drying a person's hands, face or hair.

Wall mounted dryers are frequently used in washrooms, restrooms, locker rooms and the like that are used by the public in general, employees of a company, or other persons admitted to a public or semi-public facility. Such dryers are normally electrically operated both for heating the air and operating the fan or blower for circulating the air through the self contained dryer unit. Normally an inlet for the air is provided on the front or lower surface of the dryer unit through which air is drawn to be heated and dispensed through a nozzle or opening on the front of the dryer. Since these dryers are commonly used in public areas, they are subject to vandalism and pranks, and one of the most common problems is the introduction of a foreign object or material into the air intake opening. For efficient operation of the dryer the intake opening must be relatively large but even the use of a grill with small openings does not prevent vandalism or pranks. The damage to the dryer and potential danger can be substantial if an object, such as a metal bar or screwdriver is inserted into the mechanism and engages a moving part or electrical components.

Moreover, the grill covering the inlet opening of a wall mounted dryer tends to become coated with lent, dust and dirt by reason of the air being drawn therethrough and therefore becomes unsightly and unsanitary.

Thus, it is a principle object of this invention to provide a wall mounted dryer with a novel form of air inlet which is appropriately sized and located to minimize the accidental or intentional introduction of foreign objects into the dryer. A still further object of this invention is to provide a dryer with such an inlet opening that is somewhat concealed or unobvious and attractive, and further does not lose its attractiveness after lengthy use.

The invention will now be described in connection with a preferred embodiment as shown by the enclosed drawings, wherein.

Figure 1:
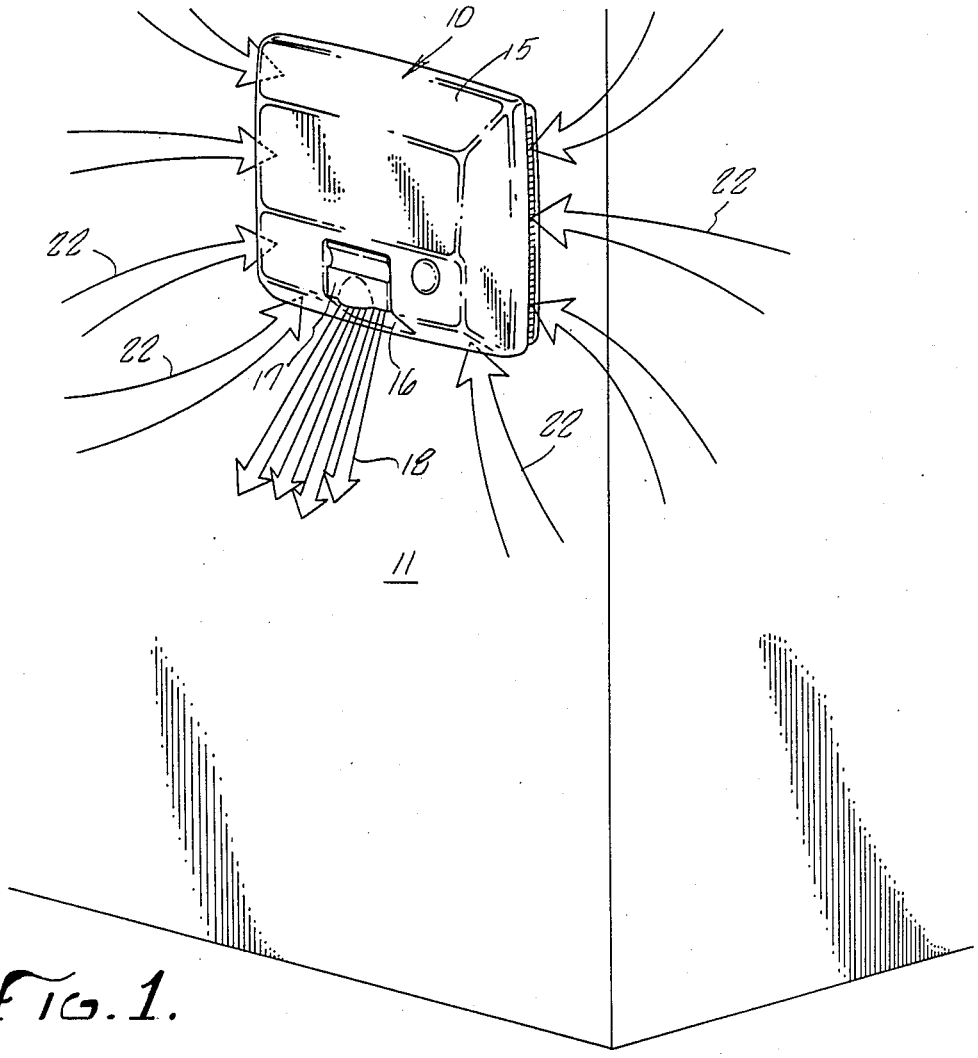
FIG. 1 is a perspective view of the wall mounted dryer of this invention mounted on a wall.

The wall mounted dryer unit, generally designated 10, of this invention is shown as a recessed type wherein a portion of the unit 10 is recessed within the wall 11 behind the wall surface 12. However, it is to be understood that the invention described herein is equally applicable to a surface mounted type dryer unit wherein little or no portion of the unit extends into the wall.

The dryer unit 10 has a housing 13 for supporting the operating components (not shown) of the dryer such as the electric heating element, the fan or blower, timer control, etc. The housing 13 is comprised of a support frame or base plate 14 that may be of any conventional construction but preferably is a metal casting. The housing 13 includes a cover 15 that is mounted on the frame or base plate 14 and the cover may be of any decorative shape and finish that is desired. The cover 15 includes an outlet opening 16 to which a diverter 17 may be mounted for directing the heated outlet air as shown by arrows 18.

Figure 2:
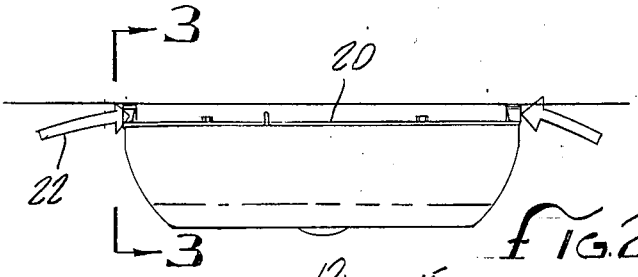
FIG. 2 is a top plan view of the dryer of FIG. 1.
Figure 4:
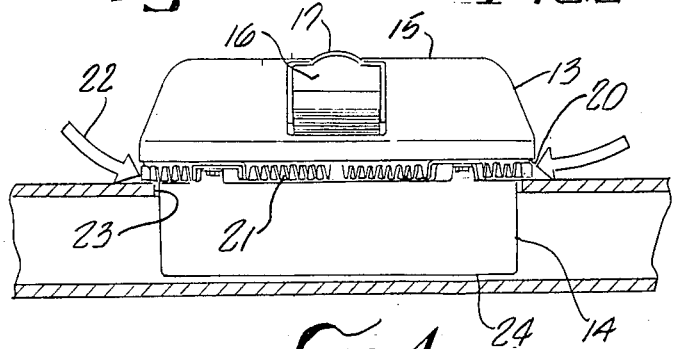
FIG. 4 is a bottom view of the dryer of this invention taken substantially on the line IV—IV shown in FIG. 3.
Figure 3:
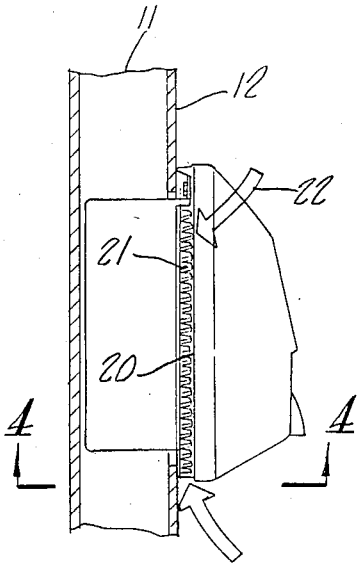
FIG. 3 is a side elevation view of the dryer of this invention taken substantially on the line III—III in FIG. 2.

The cover 15 has a circumferential edge 20 extending around the cover at a location closely spaced from the wall surface 12 then the cover 15 is mounted on the support frame 14 and the dryer 10 is mounted in the wall 11. The housing 13 includes an air inlet opening 21 along the bottom and both sides of the housing immediately adjacent the wall surface 12 and preferably that inlet opening 21 is formed in the support frame 14 although alternatively it may be formed in the cover 15. Further, the air inlet 21 is provided with louvres extending generally perpendicular to the wall surface 12 and preferably at an acute angle to the edge 20 of the cover 15. The louvres along the sides of the dryer unit 10 are preferably inclined at an angle extending downwardly from the inside of the unit as shown in FIG. 3. The top portion of the housing 13 does not include the air inlet 21, but rather the support frame 14 and cover 15 are in mating engagement to close the top as shown in FIG. 2. Thus, the incoming air drawn into the dryer unit 10 enters through the narrow peripheral opening 21 along the sides and bottom as shown by arrows 22. As shown in FIGS. 3 and 4, a substantial portion of frame 14 of housing 13 extends through an opening 23 into the wall 11 for recessing the unit 10, whereby the inlet opening 21 with louvres is provided at a substantial distance from the base 24 of the support frame 14. In contrast, for a surface mounted dryer unit embodying the present invention, the base 24 of the support frame 14 will be mounted on the wall surface 12 and the air inlet opening 21 with louvres will be provided around the periphery of the base 24 at the wall. Further, for such surface mounted unit, the cover 15 will extend a greater distance to again terminate in an edge 20 closely spaced from the wall surface 12.

By the arrangement of this invention, a very narrow air inlet 21 is provided immediately adjacent the wall surface 12 to provide substantial difficulty to a person attempting to insert a foreign object of any substantial size into the dryer unit 10 through the air inlet 21. Further, since the air inlet 21 is immediately adjacent the wall it is not immediately apparent to a person bent on vandalism or destruction. The closely spaced louvres in the inlet opening 21 and their inclined arrangement further inhibit visibility and insertion of a foreign object. Although the air inlet opening 21 is very narrow, because it extends around three of the four sides of the dryer unit 10, it provides an adequate cross-sectional area for relatively unrestricted and low velocity air flow into the unit thereby avoiding any reduction in efficiency of the dryer unit 10. The closed top edge of the dryer unit prevents pouring liquid or dropping small objects into the unit.

Although the invention has been described in connection with a preferred embodiment, namely, a recessed type wallmounted dryer unit, it is to be understood and will readily appear to those skilled in the art that the invention is equally applicable to numerous types and configurations of devices that are within the scope of the appended claims.

We claim:

1. In a dryer for mounting on a wall, an improvement comprising; a housing means including a support frame and a cover mounted on the support frame, said support frame having air inlet means extending along and adjacent the wall, and said cover having a peripheral edge closely spaced from the wall around a substantial portion of the support frame for forming a narrow opening at said air inlet means for inhibiting the entry of foreign objects into the housing means said support frame and cover having cooperating top portions when mounted on the wall to form a closed top for preventing the entry of foreign objects and water into the dryer from above the dryer.

2. The dryer of claim 1 wherein said air inlet means includes closely spaced louvers for further inhibiting the entry of foreign objects.

3. The dryer of claim 2 wherein said louvres are substantially perpendicular to the wall.

4. The dryer of claim 3 wherein said louvres are at an acute angle to an outer surface of the cover at the louvres.

5. The dryer of claim 1 wherein said support frame includes a portion extending in an opening in the wall for recessing a portion of the dryer.

6. A dryer for mounting on a wall including a support frame for mounting to the wall, said support frame having two sides, a top and a bottom adated to be adjacent the wall when mounted, said support frame having a plurality of closely spaced louvres extending around a substantial portion of the two sides and bottom of the support frame and along a plane adapted to be coincident with an outer surface of the wall when the dryer is mounted to the wall, said louvres being substantially perpendicular to said plane and inclined both downwardly and outwardly from the support frame when the dryer is mounted to the wall, a cover mounted on said support frame and having an edge extending along and adjacent to said louvres, said edge being closely spaced from the wall when the dryer is mounted to the wall for forming a narrow air inlet along the wall outer surface and inhibiting the entry of foreign objects and water into the dryer through the louvres, and the cover having a top portion cooperating with the top of the support frame to form a closed top to prevent the entry of foreign objects and water into the dryers from above the dryer.

* * * * *